US011491608B2

(12) United States Patent
Lee et al.

(10) Patent No.: US 11,491,608 B2
(45) Date of Patent: Nov. 8, 2022

(54) DETECTION METHOD AND DETECTION APPARATUS FOR POLISHING PAD OF CHEMICAL MECHANICAL POLISHING DEVICE

(71) Applicant: Ta Liang Technology Co., Ltd., Taoyuan (TW)

(72) Inventors: Hsien-Ming Lee, Taoyuan (TW); Chun-Chen Chen, Taoyuan (TW); Ching-Tang Hsueh, Taoyuan (TW); Po-Ching Huang, Taoyuan (TW)

(73) Assignee: Ta Liang Technology Co., Ltd., Taoyuan (TW)

( * ) Notice: Subject to any disclaimer, the term of this patent is extended or adjusted under 35 U.S.C. 154(b) by 94 days.

(21) Appl. No.: 17/092,335

(22) Filed: Nov. 9, 2020

(65) Prior Publication Data

US 2021/0146501 A1 May 20, 2021

(30) Foreign Application Priority Data

Nov. 19, 2019 (TW) ..... 108141938

(51) Int. Cl.
*B24B 49/08* (2006.01)
*B24B 53/017* (2012.01)

(52) U.S. Cl.
CPC ..... *B24B 49/08* (2013.01); *B24B 53/017* (2013.01)

(58) Field of Classification Search
CPC ..... B24B 57/00; B24B 57/02; B24B 49/12; B24B 49/08
USPC ..... 451/443, 444
See application file for complete search history.

(56) References Cited

U.S. PATENT DOCUMENTS 5,708,506 A * 1/1998 Birang ..... B24B 49/12 356/600
6,425,801 B1 * 7/2002 Takeishi ..... B24B 37/013 451/6
7,020,306 B2 * 3/2006 Hirose ..... B24B 49/12 382/145
7,578,886 B2 * 8/2009 Yamada ..... C25D 17/001 134/21

(Continued)

FOREIGN PATENT DOCUMENTS

JP 2019193970 11/2019
TW M472724 2/2014

(Continued)

OTHER PUBLICATIONS

Office Action of Taiwan Counterpart Application, dated Nov. 4, 2021, pp. 1-7.

*Primary Examiner* — Joel D Crandall
*Assistant Examiner* — Jason Khalil Hawkins
(74) *Attorney, Agent, or Firm* — JCIPRNET

(57) ABSTRACT

Disclosed are a detection method and a detection apparatus for a polishing pad of a chemical mechanical polishing device, particularly a detection method and a detection apparatus for detecting a surface of a polishing pad dynamically. An isolation region isolated by a gas to expose the polishing pad is formed by the detecting device, and a detection is performed on the isolation region, such that the chemical mechanical polishing device is capable of detecting the polishing pad without interrupting a manufacturing process and the detection results with more accurate can be achieved. Thereby, the polishing pad can be repaired and replaced more timely.

5 Claims, 6 Drawing Sheets

(56) References Cited

U.S. PATENT DOCUMENTS

| | | | | |
|---|---|---|---|---|
| 9,970,754 | B2 * | 5/2018 | Cho | G01B 11/303 |
| 10,737,301 | B2 * | 8/2020 | Ishibashi | H01L 21/67051 |
| 10,919,799 | B2 * | 2/2021 | Hamilton | C03B 33/0215 |
| 11,139,182 | B2 * | 10/2021 | Mouri | B24B 37/107 |
| 11,298,798 | B2 * | 4/2022 | Wang | B24B 57/02 |
| 2014/0190633 | A1 * | 7/2014 | Maeda | H01L 21/67051 134/103.3 |
| 2014/0323017 | A1 * | 10/2014 | Tang | B24B 53/017 451/444 |
| 2015/0017880 | A1 * | 1/2015 | Nomura | H01L 22/26 451/6 |
| 2017/0059311 | A1 * | 3/2017 | Cho | G01B 11/0608 |
| 2020/0376522 | A1 * | 12/2020 | Wu | B08B 3/00 |
| 2021/0098261 | A1 * | 4/2021 | Kim | H01L 21/02074 |

FOREIGN PATENT DOCUMENTS

| | | |
|---|---|---|
| TW | 201707862 | 3/2017 |
| TW | I632988 | 8/2018 |
| WO | 2005072910 | 8/2005 |

* cited by examiner

DETECTION METHOD AND DETECTION APPARATUS FOR POLISHING PAD OF CHEMICAL MECHANICAL POLISHING DEVICE

CROSS-REFERENCE TO RELATED APPLICATION

This application claims the priority benefit of Taiwan application serial no. 108141938, filed on Nov. 19, 2019. The entirety of the above-mentioned patent application is hereby incorporated by reference herein and made a part of this specification.

BACKGROUND OF THE INVENTION

1. Field of the Invention

Disclosed are a detection method and a detection apparatus for a polishing pad of a chemical mechanical polishing device, particularly a detection method and a detection apparatus for detecting a surface of the polishing pad of the chemical mechanical polishing device.

2. Description of Related Art

Principles of chemical polishing and mechanical polishing are combined in a chemical mechanical polishing device to implement uniform polishing on an extremely composite material. A surface of the polishing pad of the chemical mechanical polishing device needs to be trimmed after being used for a period of time to maintain polishing ability of the polishing pad. In an existing method for repairing the polishing pad, repair and replacement are performed based on a life time provided by a polishing pad manufacturer or experience of a user. However, due to the different wear degrees of the polishing pad caused by different polishing processes, the repair and replacement are often not timely performed. In order to resolve the repair and replacement of the polishing pad, related practitioners determine the repair or replacement by detecting a surface of the polishing pad. Because there is a polishing liquid layer on the surface of the polishing pad, a current measurement apparatus for detecting the surface of the polishing pad is placed on the surface of the polishing pad and an immersion lens is used to be immersed into the polishing liquid layer to test the surface of the polishing pad. This method may only perform a single-point test and needs to interrupt a manufacturing process for test, so that not only the repair and replacement of the polishing pad cannot be timely implemented, but also the entire manufacturing process is affected and an output is further reduced greatly as well as. This detecting method is further used in measurement of a film thickness of a wafer, and a difficulty in design of a measurement device of the film thickness of the wafer is also caused. Therefore, according to "DEVICE FOR MEASURING FILM THICKNESS, METHOD FOR MEASURING FILM THICKNESS, AND POLISHING DEVICE HAVING THE DEVICE FOR MEASURING FILM THICKNESS" with the Patent No. I632988 of the Republic of China, related practitioners propose a device for measuring a film by using a gas, pure water, or other fluid to partially remove a film of purging water formed on a measurement region. In such method, although a problem of use of an immerse lens during measurement is resolved, such method is also the single-point test and cannot be used in the polishing pad.

Therefore, how to resolve the foregoing known problems and deficiencies is an issue to be researched and developed by the related practitioners.

SUMMARY OF THE INVENTION

The invention is mainly directed to provide a detection method and a detection apparatus for a polishing pad of a chemical mechanical polishing device, so that the chemical mechanical polishing device is capable of detecting the polishing pad without interrupting a manufacturing process and the detection results with more accurate can be achieved. Thereby, the polishing pad can be repaired and replaced more timely.

In order to achieve the foregoing objective, the invention provides a detection method for a polishing pad of a chemical mechanical polishing device, and particularly a method for detecting a surface of a polishing pad dynamically. The chemical mechanical polishing device has a polishing pad disposed on a base and a polishing liquid layer covering the surface of the polishing pad, and the detection method includes following steps: rotating a base to drive the polishing pad to pivot; injecting a gas from above the polishing liquid layer toward the surface of the polishing pad, so that an isolation region isolated by the gas to expose the polishing pad is formed on the polishing liquid layer; and detecting a portion of the polishing pad exposed by the polishing liquid layer.

For the foregoing detection method for a polishing pad of a chemical mechanical polishing device, the isolation region formed by the gas on the polishing liquid layer is horizontally moved toward an inner side or an outer side of the polishing pad, and during the move of the isolation region, the portion of the polishing pad exposed by the polishing liquid layer is continuously detected.

In addition, a detection apparatus for a polishing pad of a chemical mechanical polishing device of the invention is provided with the chemical mechanical polishing device and a detecting device. The chemical mechanical polishing device has a polishing pad, a polishing liquid layer, and a base, and the polishing pad is positioned to cover the base, and the polishing liquid covers a surface of the polishing pad. The detecting device has a detector for detecting the surface of the polishing pad, and an isolator allowing the polishing liquid layer to generate an isolation region exposed the polishing pad by using a gas injection.

For the foregoing detection apparatus for a polishing pad of a chemical mechanical polishing device, the isolator of the detecting device has a gas nozzle for injecting a gas, and a range of the gas injected by the gas nozzle includes a detecting position of the detector.

For the foregoing detection apparatus for detecting a polishing pad of a chemical mechanical polishing device, the isolator of the detecting device has a first gas nozzle and a second gas nozzle for injecting a gas, the first gas nozzle injects the gas toward a center of the detecting position of the detector, and the second gas nozzle injects the gas toward an outer edge of the detecting position of the detector.

For the foregoing detection apparatus for a polishing pad of a chemical mechanical polishing device, the detecting device is further provided with a shifter, the shifter has a driving unit and a swing arm connected to the driving unit, the detector and the isolator are connected to the swing arm, and the swing arm drives the detector and the isolator to move horizontally above the polishing pad toward an inner side or an outer side of the polishing pad.

DESCRIPTION OF THE EMBODIMENTS

Figure 1:
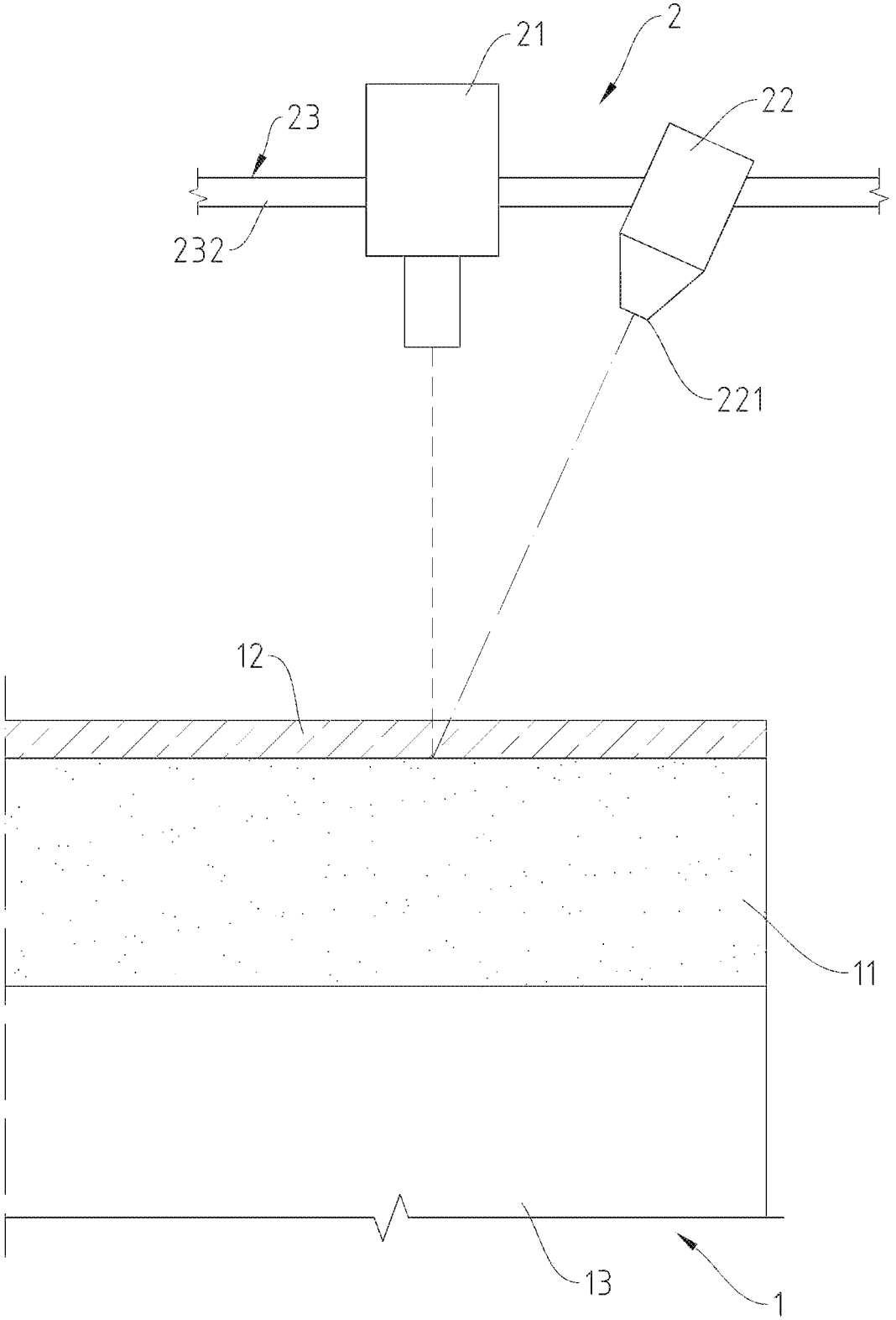
FIG. 1 is a schematic diagram of an appearance of the invention.
Figure 2:
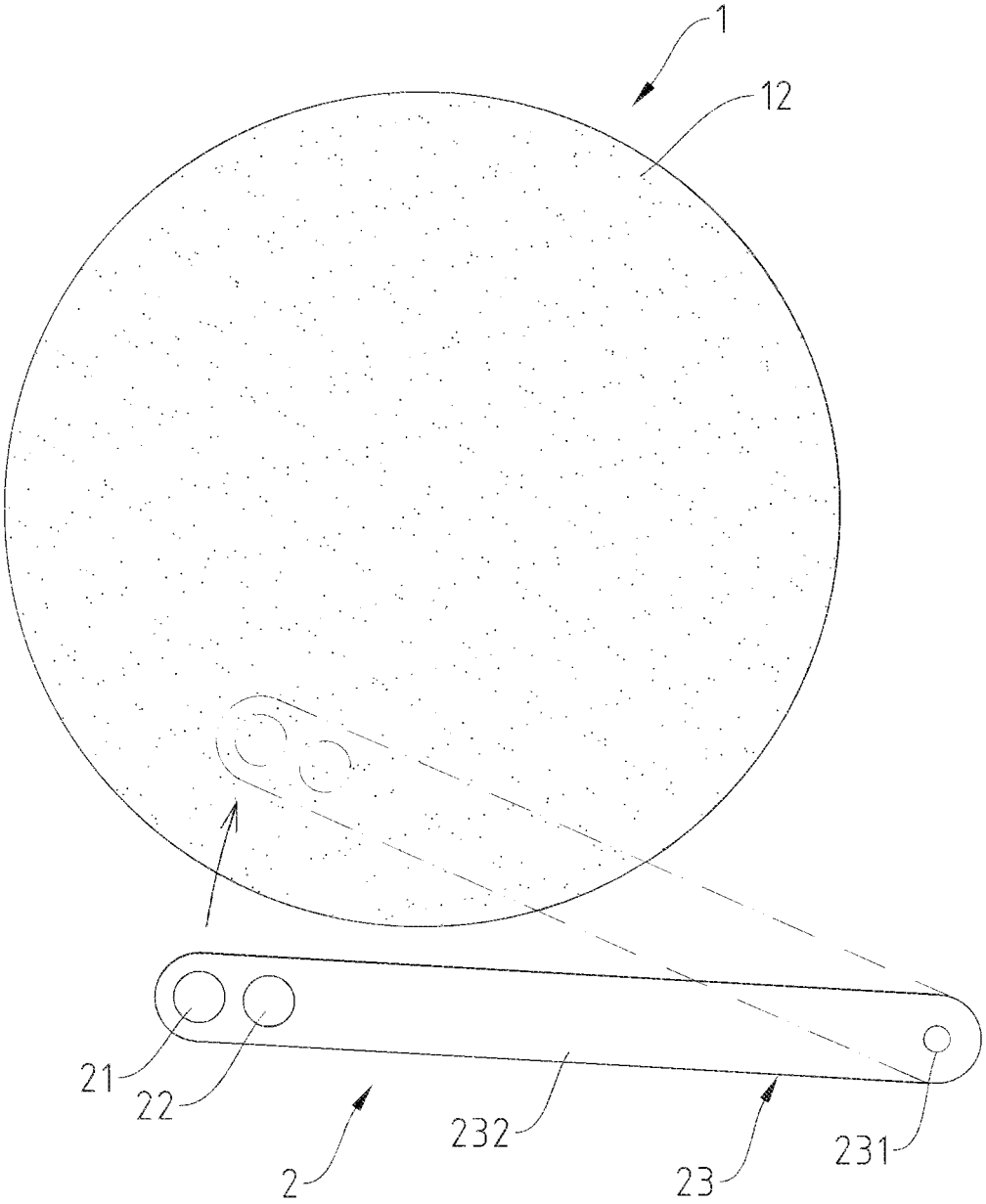
FIG. 2 is a schematic diagram of an action of a detection apparatus of the invention.
Figure 3:
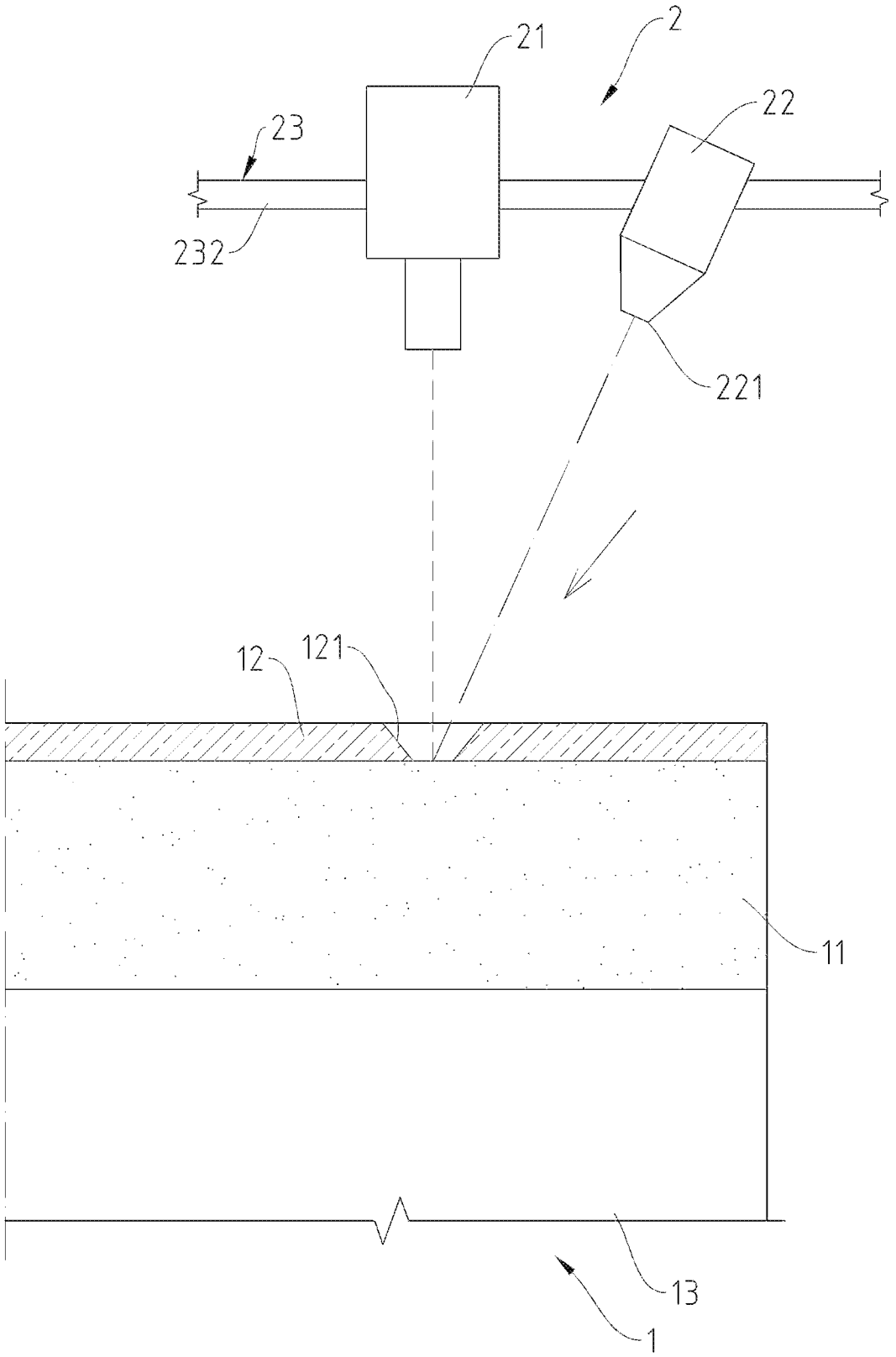
FIG. 3 is a schematic diagram of the detection apparatus of the invention during detection.

Referring to FIG. 1 to FIG. 3, it can be clearly seen from the figures that the invention has a chemical mechanical polishing device 1 and a detecting device 2.

The chemical mechanical polishing device 1 has a polishing pad 11, a polishing liquid layer 12, and a base 13. The polishing pad 11 is positioned to cover the base 13, and the polishing liquid layer 12 covers a surface of the polishing pad 11.

The detecting device 2 has a detector 21, an isolator 22, and a shifter 23. The shifter 23 has a driving unit 231 and a swing arm 232 connected to the driving unit 231. The detector 21 and the isolator 22 are connected to the swing arm 232. In the present embodiment, the detector 21 and the isolator 22 are connected to the swing arm 232 side by side.

Based on the foregoing, when the surface of the polishing pad 11 is detected, a gas nozzle 221 of the isolator 22 injects a gas into a detecting position of the detector 21. Airflow is used to allow a polishing liquid layer 12 to generate an isolation region 121 to expose the polishing pad 11, so that the detector 21 may detect a position exposed by the isolation region 121. In addition, the base 13 is configured to drive the polishing pad 11 to rotate, and the swing arm 232 is configured to drive the detector 21 and the isolator 22 to move horizontally above the polishing pad 11 toward an inner side or an outer side of the polishing pad 11, so that the detector 21 may detect the polishing pad 11 comprehensively without interrupting a manufacturing process of the chemical mechanical polishing device 1.

Figure 4:
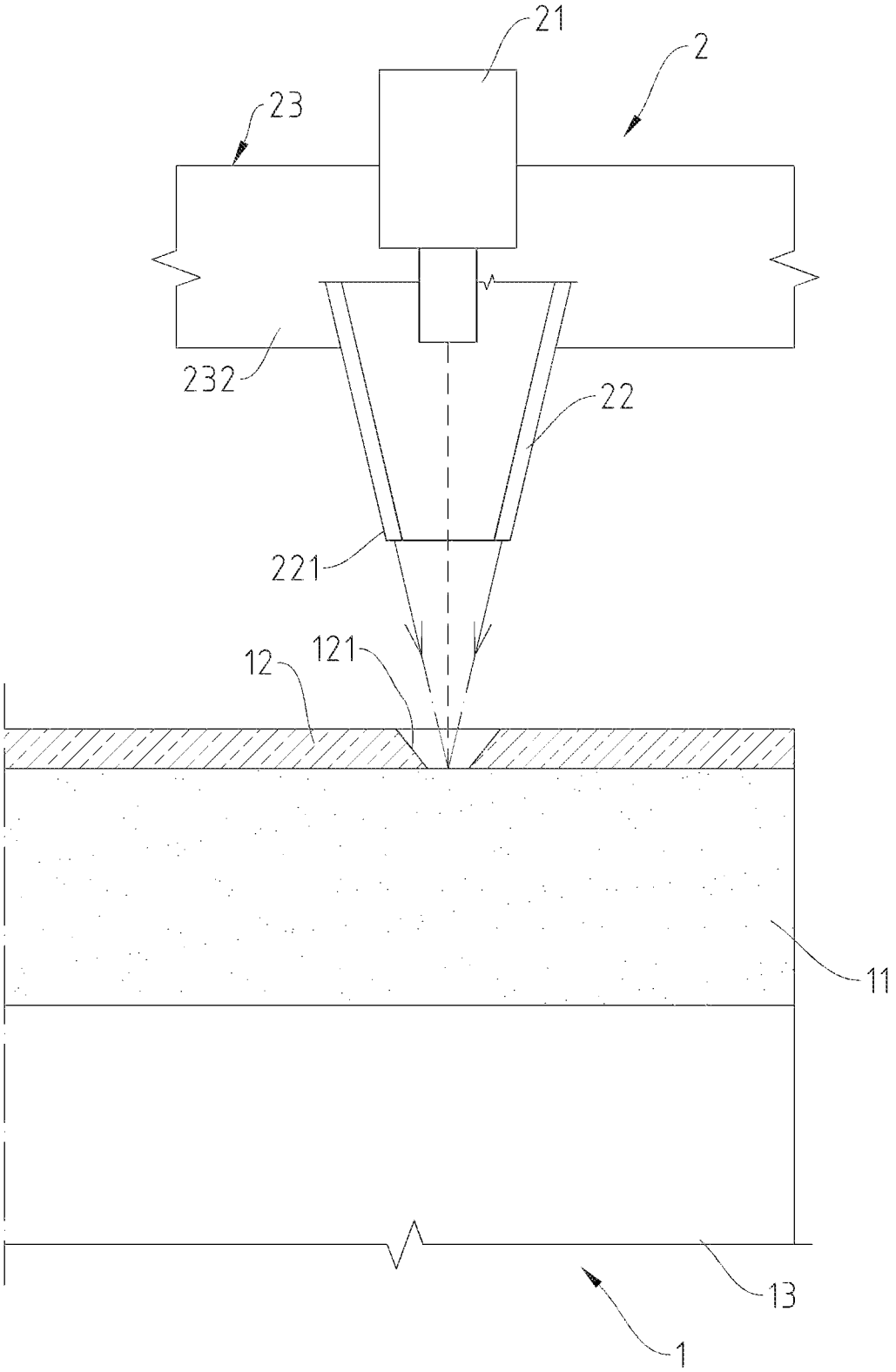
FIG. 4 is a schematic diagram of an action of the detection apparatus according to another embodiment of the invention.
Figure 5:
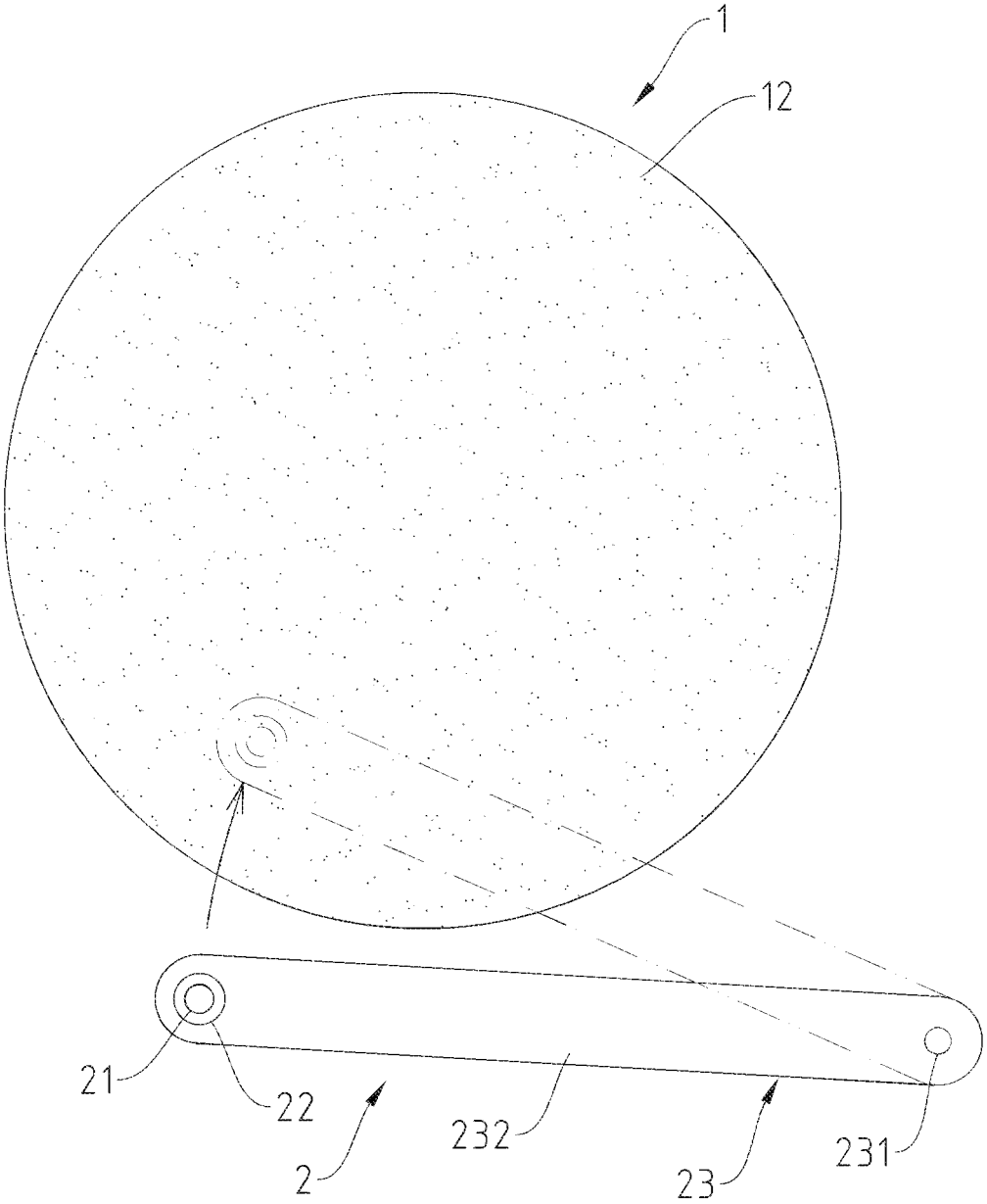
FIG. 5 is a schematic diagram of the detection apparatus during detecting according to still another embodiment of the invention.

Referring to FIG. 4 and FIG. 5, it can be clearly seen from the figures that a detector 21 and an isolator 22 of a detecting device 2 of the invention are connected to a swing arm 232 through an inner layer and an outer layer. Similarly, when the detecting device 2 detects a surface of a polishing pad 11, an air nozzle 221 of the isolator 22 uses airflow to allow a polishing liquid layer 12 to generate an isolation region 121, the base 13 is configured to drive the polishing pad 11 to rotate, and the swing arm 232 is configured to drive the detector 21 and the isolator 22 to move horizontally above the polishing pad 11 toward an inner side or an outer side of the polishing pad 11, so that the detector 21 may detect the polishing pad 11 comprehensively.

Figure 6:
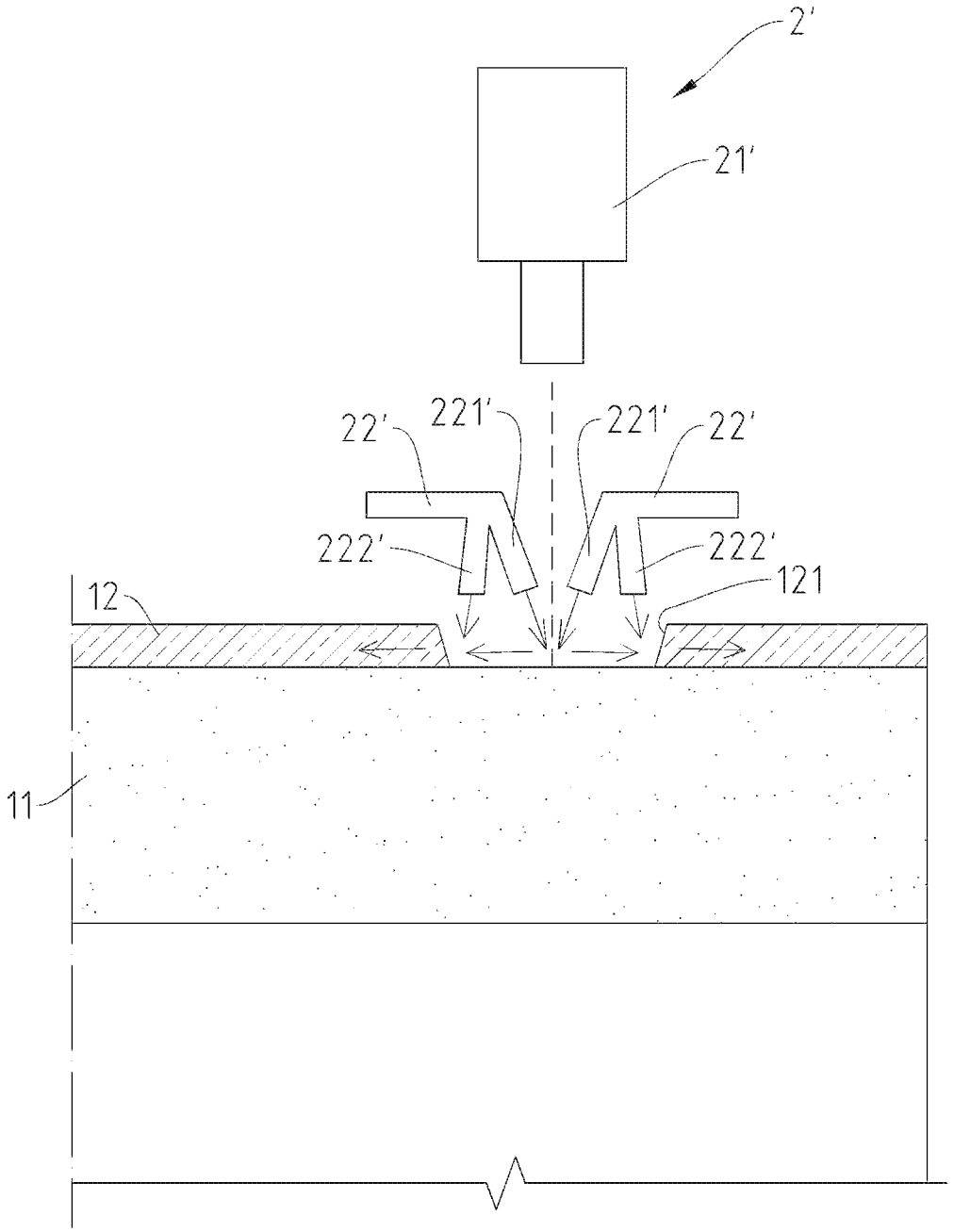
FIG. 6 is a schematic diagram of the detection apparatus during detecting according to yet another embodiment of the invention.

Referring to FIG. 6, it can be clearly seen from the figures that isolators 22' of a detecting device 2' of the invention is disposed in pair, and each of the isolators 22' has a first gas nozzle 221' and a second gas nozzle 222' for injecting a gas. The first gas nozzle 221' injects the gas toward a center of a detecting position of the detector 21', and the second gas nozzle 222' injects the gas toward an outer edge of the detecting position of the detector 21'. Therefore, the first air nozzle 221' pushes liquid of the polishing liquid layer 12 from the center of the detecting position toward an outer edge, and the second air nozzle 222' is configured to form an air wall at the outer edge of the detecting position to block liquid of the polishing liquid layer 12 from flowing toward the center of the detecting position. Therefore, not only a larger isolation region 121 is generated by the detector 21' in the polishing liquid layer 12 at the detecting position of the polishing pad 11, but also a liquid residue of the polishing liquid layer 12 in the isolation region 121 may be further reduced and detecting accuracy may be further improved.

What is claimed is:

1. A detection method for a polishing pad of a chemical mechanical polishing device, and particularly a method for detecting a surface of a polishing pad dynamically, wherein the chemical mechanical polishing device has a polishing pad disposed on a base and a polishing liquid layer covering the surface of the polishing pad, and the detection method comprises following steps:

rotating the base to drive the polishing pad to pivot;

injecting a gas from above the polishing liquid layer toward the surface of the polishing pad, so that an isolation region isolated by the gas to expose the polishing pad is formed on the polishing liquid layer; and detecting a surface area on the polishing pad being exposed by the isolation region, wherein the chemical mechanical polishing device comprises a detecting device for detecting the surface area on the polishing pad being exposed by the isolation region, and the detecting device has an isolator comprising:

a first gas nozzle for injecting a first portion of the gas toward a central portion of the surface area on the polishing pad being exposed by the isolation region; and a second gas nozzle for injecting a second portion of the gas toward an outer portion of the surface area on the polishing pad being exposed by the isolation region to form a gas wall for blocking a portion of the polishing liquid layer that is isolated by the first portion of the gas flowing back to the central portion of the surface area.

2. The detection method for the polishing pad of the chemical mechanical polishing device according to claim 1, wherein the isolation region formed by the gas on the polishing liquid layer is horizontally moved toward an inner side or an outer side of the polishing pad, and during the move of the isolation region, the surface area on the polishing pad being exposed by the isolation region is continuously detected.

3. A detection apparatus for a polishing pad of a chemical mechanical polishing device, comprising at least:

a chemical mechanical polishing device comprising a polishing pad, a polishing liquid layer, and a base, wherein the polishing pad is positioned and covered on the base, and the polishing liquid layer covers a surface of the polishing pad; and a detecting device comprising an isolator for generating an isolation region on the polishing liquid layer by injecting a gas to expose the polishing pad and a detector for detecting a surface area on the polishing pad being exposed by the isolation region, wherein the isolator comprises:

a first gas nozzle for injecting a first portion of the gas toward a central portion of the surface area on the polishing pad being exposed by the isolation region; and a second gas nozzle for injecting a second portion of the gas toward an outer portion of the surface area on the polishing pad being exposed by the isolation region to form a gas wall for blocking a portion of the polishing liquid layer that is isolated by the first portion of the gas flowing back to the central portion of the surface area.

4. The detection apparatus for the polishing pad of the chemical mechanical polishing device according to claim 3, wherein the first portion of the gas injected by the first gas nozzle exposes a portion of the polishing pad being detected by the detector.

5. The detection apparatus for the polishing pad of the chemical mechanical polishing device according to claim 3, wherein the detecting device is further provided with a shifter, the shifter has a driving unit and a swing arm connected to the driving unit, the detector and the isolator are connected to the swing arm, and the swing arm drives the detector and the isolator to move horizontally above the polishing pad toward an inner side or an outer side of the polishing pad.

* * * * *